US005724750A

United States Patent [19]

Burress

[11] Patent Number: 5,724,750

[45] Date of Patent: Mar. 10, 1998

[54] CLOTHES DRYER WITH PELTIER EFFECT HEATING, INFRARED HEATING, AND VACUUM DRYING CAPABILITIES

[76] Inventor: Vergel F. Burress, 3118 Pleasant Valley, Sachse, Tex. 75048

[21] Appl. No.: 558,390

[22] Filed: Nov. 16, 1995

[51] Int. Cl.[6] ..... F26B 3/34

[52] U.S. Cl. ..... 34/267; 34/92; 34/595; 34/603

[58] Field of Search ..... 34/92, 260, 261, 34/263, 267, 132, 595, 602, 603, 605, 408; 219/389; 392/375, 376, 418, 378

[56] References Cited

U.S. PATENT DOCUMENTS

| | | | |
|---|---|---|---|
| 3,915,180 | 10/1975 | Jacobs | 134/57 D |
| 4,057,907 | 11/1977 | Rapino et al. | 34/261 |
| 4,413,425 | 11/1983 | Candor | 34/1 |
| 4,628,620 | 12/1986 | Klemm | 34/236 |
| 4,693,013 | 9/1987 | Pabst et al. | 34/4 |
| 4,703,565 | 11/1987 | Kantor | 34/1 |
| 4,771,156 | 9/1988 | Strattan et al. | 219/10.55 |
| 5,220,813 | 6/1993 | Chen et al. | 68/3 SS |
| 5,273,589 | 12/1993 | Griswold et al. | 134/21 |
| 5,287,587 | 2/1994 | Yonkers et al. | 15/320 |
| 5,315,765 | 5/1994 | Holst et al. | 34/260 |
| 5,343,632 | 9/1994 | Dinh | 34/507 |
| 5,353,519 | 10/1994 | Kanamaru et al. | 34/92 |
| 5,357,771 | 10/1994 | Schaal | 68/18 C |
| 5,368,649 | 11/1994 | Tsukazaki | 134/1 |

*Primary Examiner*—Henry A. Bennett
*Assistant Examiner*—Steve Gravini
*Attorney, Agent, or Firm*—H. Dennis Kelly; Jeffrey T. Hubbard; Timmons & Kelly

[57] ABSTRACT

A rotatable drum forms an airtight seal with a door. A vacuum line connects the interior of the drum to a vacuum pump. A shutoff valve closes the vacuum line to the pump. A pressure equalization valve connects the drum to the outside atmosphere. A bearing supports the drum, in combination with the vacuum line. Infrared lamps heat clothes placed inside the drum. The vacuum pump reduces the air pressure in the drum below atmospheric pressure, reducing the evaporation temperature of the water in the clothes. A heat sensor measures the temperature of the air leaving the drum. Solenoid-driven purge valves allow air to enter the drum in short bursts, thus aiding the drying of the clothes.

10 Claims, 5 Drawing Sheets

CLOTHES DRYER WITH PELTIER EFFECT HEATING, INFRARED HEATING, AND VACUUM DRYING CAPABILITIES

BACKGROUND OF THE INVENTION

1. Field of the Invention

This invention relates in general to apparatus for drying clothes. In particular, the invention relates to a dryer utilizing pressure below atmospheric pressure for speeding the drying process.

2. Description of the Related Art

At reduced pressures, the boiling point of liquids such as water decreases. This phenomenon can been applied to the task of drying clothes. Advantages include lower drying temperatures and reduced drying times.

U.S. Pat. No. 5,357,771, issued to Schaal, discloses an apparatus utilizing dry cleaning solvent instead of water for washing clothes. This same apparatus also dries the clothes by reducing pressure in the cleaning chamber. A vacuum is used to reduce the solvent boiling point for safety reasons. The device is designed for use in the dry cleaning industry, and cannot be operated by the average consumer at home. The apparatus is too complex and expensive for the consumer market, because of the equipment and materials required to keep the solvent from exploding.

A need remained for a clothes dryer that dries clothes in less time and at lower temperature. A dryer that minimizes secondary heating of the surrounding environment was also desired.

SUMMARY OF THE INVENTION

The general object of the invention is to dry clothes more quickly and with less energy consumption than conventional clothes dryers. Another object of the invention is to dry clothes at lower temperatures than conventional clothes dryers, so that fabric shrinkage and other undesirable effects are minimized. A third object is to minimize heating of the surrounding environment by the dryer.

In general, these objects are achieved by a drum with a door that forms an airtight seal with the drum, a vacuum line running from the drum to a vacuum pump, a vacuum shutoff valve for allowing the flow of air out of the drum to the vacuum pump, and a pressure equalization valve, for restoring atmospheric pressure inside the drum. In one embodiment, the drum is made of a material such as polycarbonate resin, and infrared lamps are positioned about the circumference of the drum to heat the clothes through the drum. In an alternative embodiment, the drum is made of metal, and a number of cold junction diodes provide the means for heating the clothes. Cold junction diodes are semiconductor diodes exhibiting Peltier effect characteristics. A heat sensor is installed within the vacuum line at the point where the vacuum line enters the drum, and monitors the temperature of air leaving the drum. The temperature measurement from the heat sensor is used to regulate the heat output of the lamps (or diodes).

By reducing the pressure inside the drum to about 1.5 pounds per square inch absolute (10.3 kPa absolute), drying temperatures of about 115° Fahrenheit (46° Celsius) can be employed. Drying time is still shorter than a conventional dryer running at 150° Fahrenheit (66° Celsius). The lower drying temperatures reduce secondary heating of the surrounding environment, and reduce shrinking of the clothes.

The above, as well as additional objects, features, and advantages of the invention will become apparent in the following detailed description and in the drawings.

DESCRIPTION OF THE PREFERRED EMBODIMENT

Figure 1:
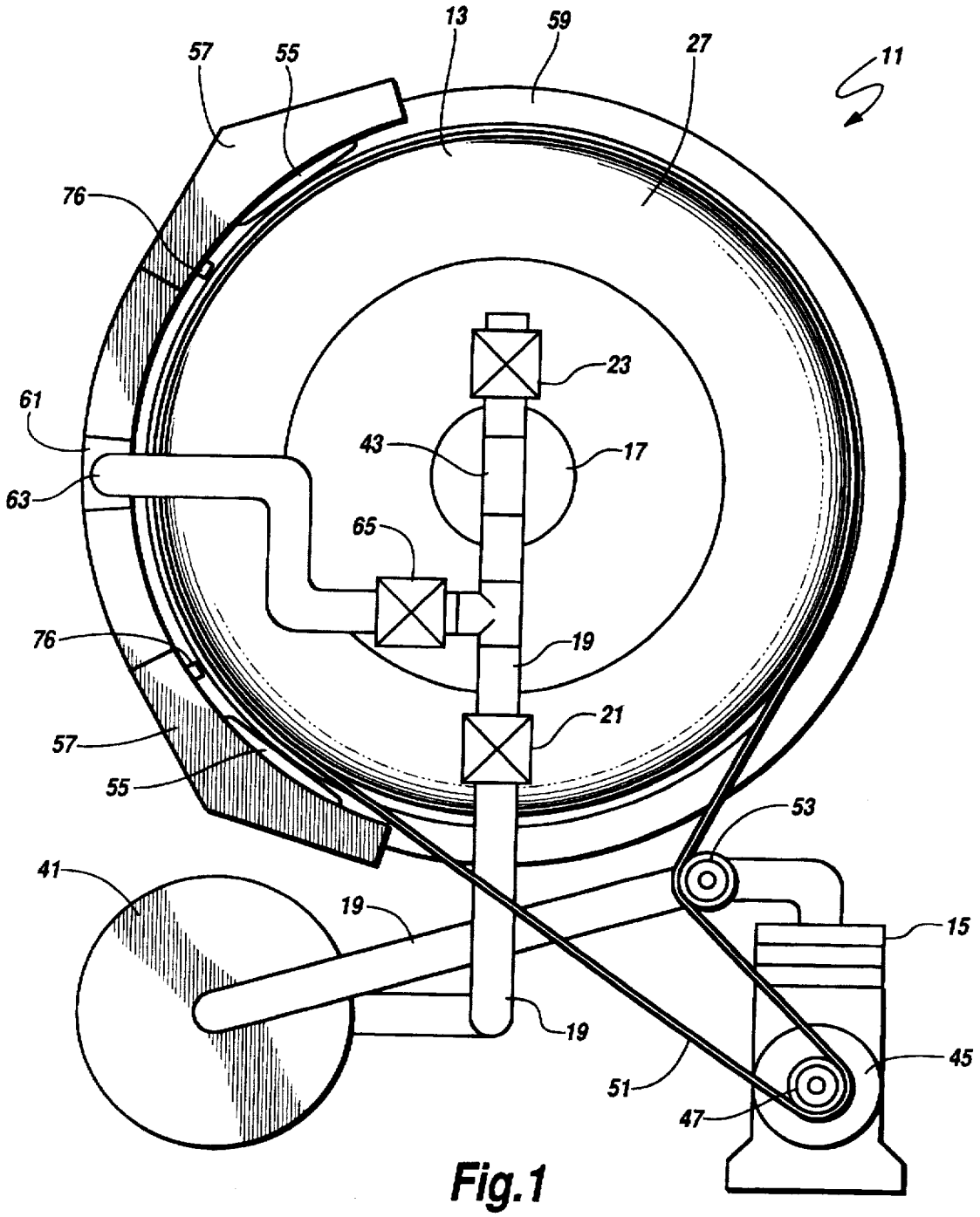
FIG. 1 is a schematic rear elevation of a clothes dryer according to the invention, omitting mounting and support elements, cabinet and other elements well known in the industry.
Figure 2:
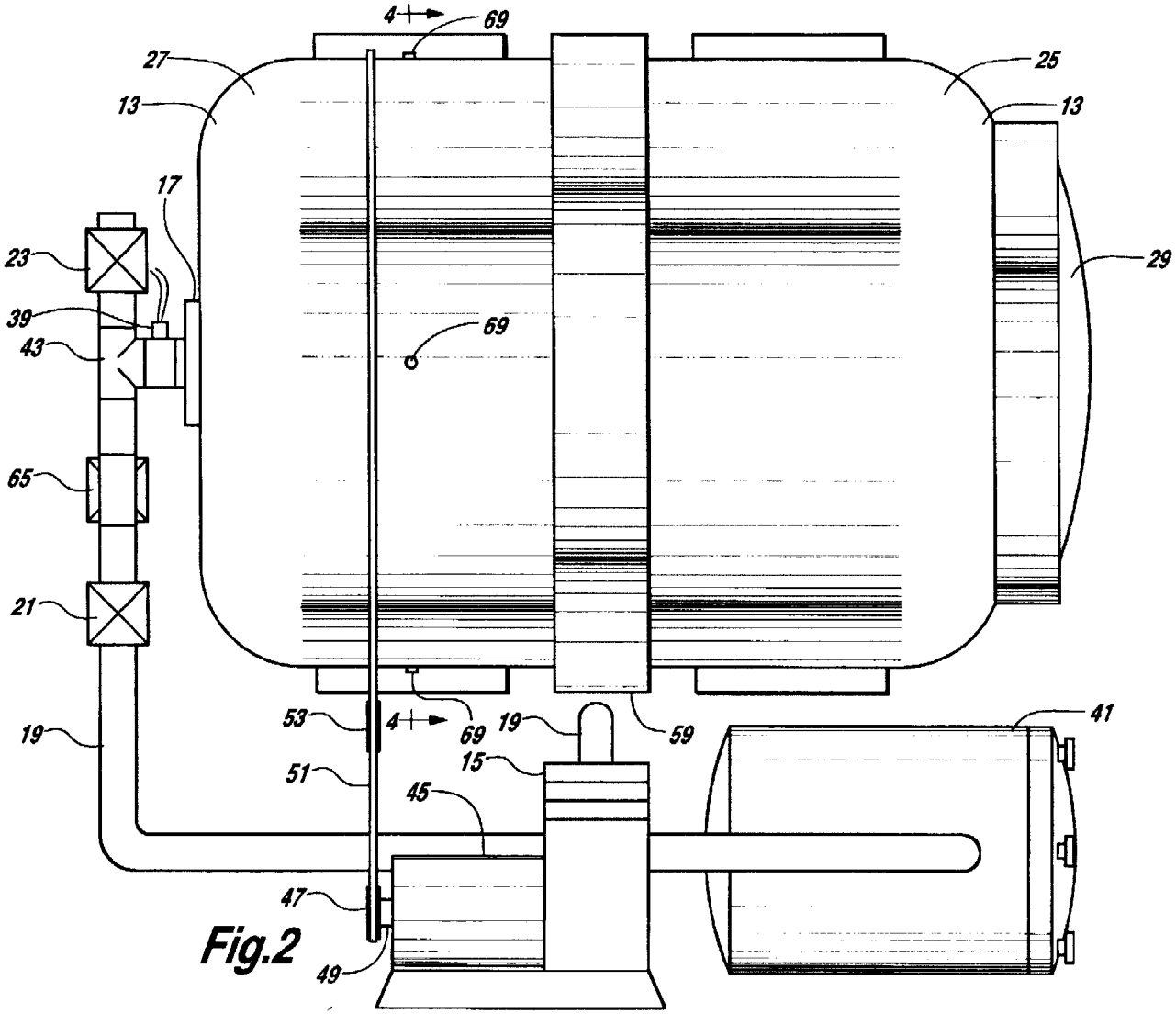
FIG. 2 is a right side elevation thereof.
Figure 3:
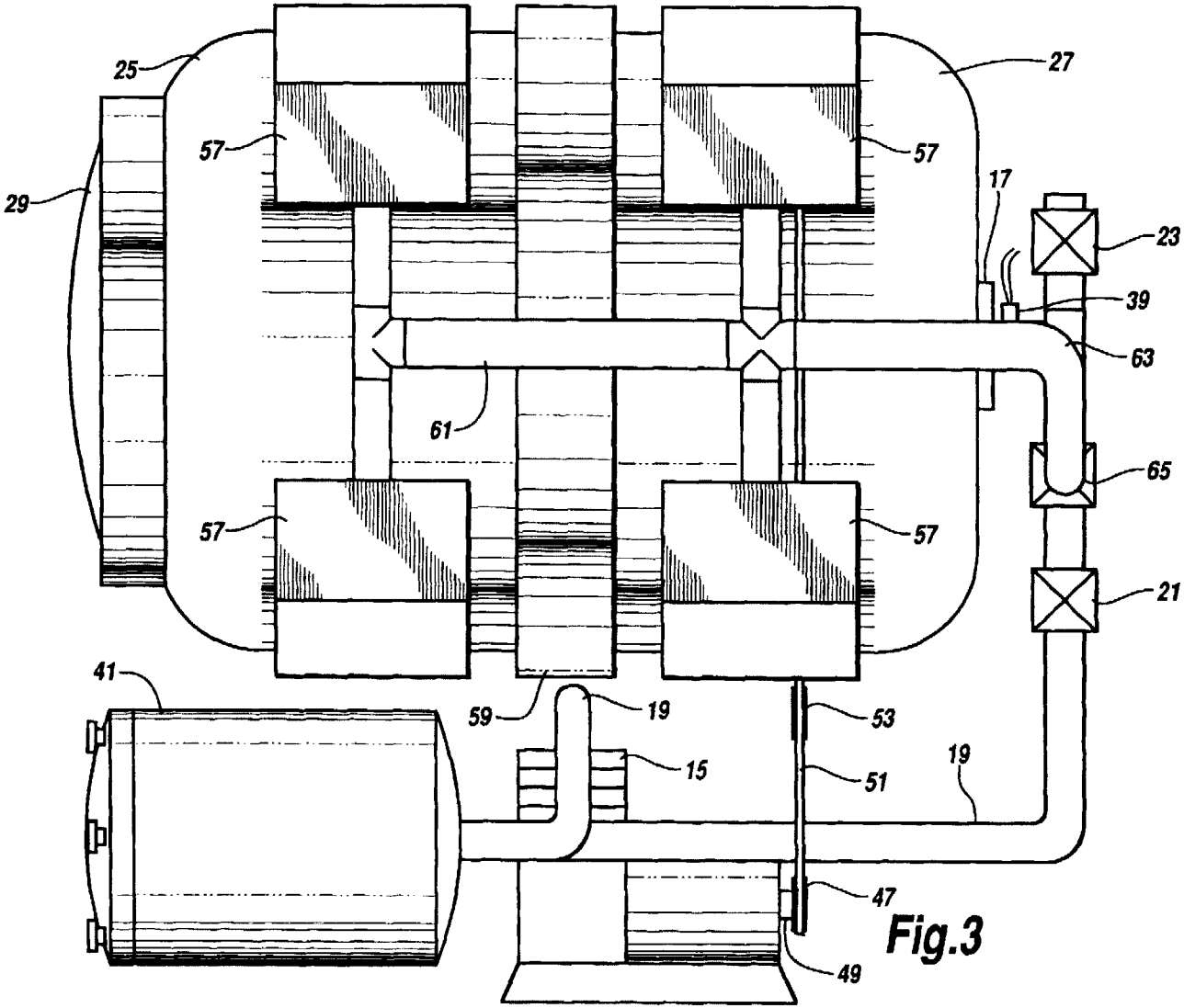
FIG. 3 is a left side elevation thereof.

As shown in FIGS. 1–3, the clothes dryer 11 includes a drum 13, a vacuum pump 15, a bearing 17 supporting the drum 13, a vacuum line 19, a vacuum shutoff valve 21, and a pressure equalization valve 23. The drum 13 is about two feet (sixty centimeters) in diameter and is made of polycarbonate resin of sufficient thickness to withstand a perfect vacuum (i.e. zero psi absolute) inside the drum 13, with normal atmospheric pressure outside the drum 13. The drum 13 has an open end 25 and a closed end 27. A door 29 is pivotably attached to the open end 25 of the drum 13. The door 29 and drum 13 form an airtight seal when the door 29 is closed and secured in place.

The vacuum line 19 connects the interior of the drum 13 to the vacuum pump 15. The vacuum pump 15 is capable of reducing the pressure inside the drum 13 to 0.37 psi absolute (2.55 kPa).

Figure 5:
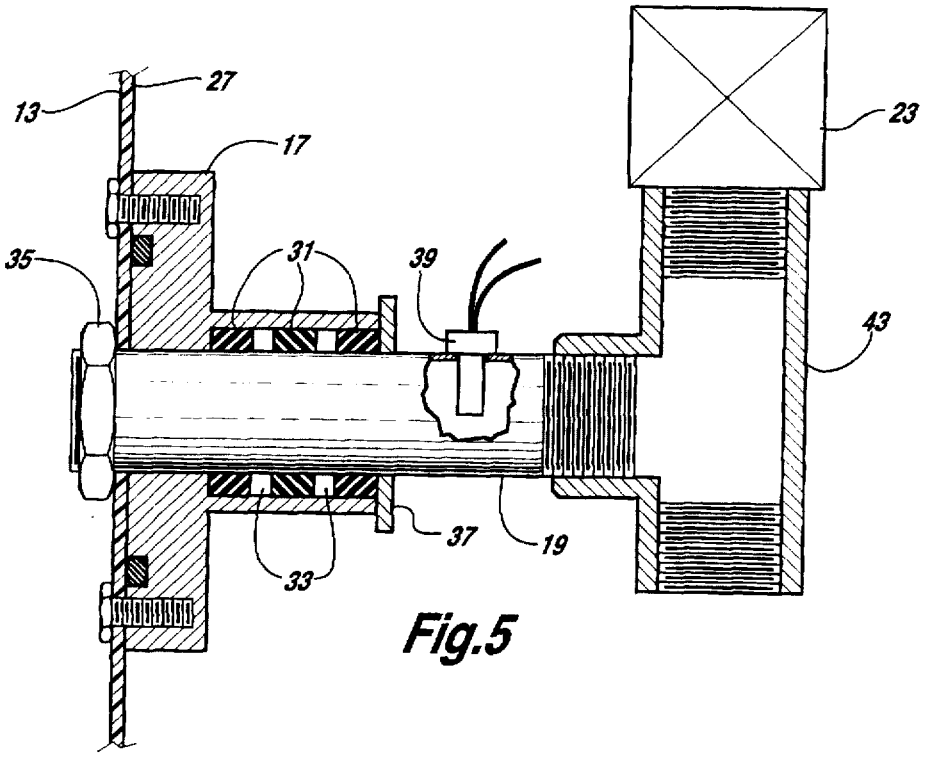
FIG. 5 is a cross-sectional right side elevation detail of the rear bearing assembly.

The bearing 17, as shown in detail in FIG. 5, passes through a hole (not shown) in the center of the closed end 27 of the drum 13, and is secured to the drum 13, forming an airtight seal. The vacuum line 19 in turn passes through the bearing 17. Three rubber seals 31, separated by metal spacers 33, form an airtight seal between the vacuum line 19 and the bearing 17. The vacuum line 19 is prevented from excessive movement relative to the drum 13 by two items: a hold down nut 35, and a thrust washer 37 that is tack welded to the vacuum line 19. A heat sensor 39 is installed in the vacuum line 19 just outside the bearing 17 to measure the temperature of air leaving the drum 13.

As shown in FIGS. 2 and 3, a filter 41 in the vacuum line 19 removes lint from the air extracted from the drum 13 before it can enter the vacuum pump 15. The filter 41 uses a standard drip-type coffee maker filter paper (not shown) as its filter element.

Two valves are installed in the vacuum line 19: the vacuum shutoff valve 21 and the pressure equalization valve 23. A vacuum shutoff valve 21 is located in the vacuum line 19 between the drum 13 and the filter 37. The shutoff valve 21 closes the drum 13 off from the vacuum pump 15 during operation, as will be described. The shutoff valve 21 is closed when deenergized and open when energized. A tee 43 is located in the vacuum line 19 near the drum 13. One branch of the vacuum line 19 coming from the tee 43 goes to the vacuum shutoff valve 21. The other branch of the vacuum line 19 coming from the tee 43 goes to the pressure equalization valve 23. The inlet of the pressure equalization valve 23 is open to the surrounding atmosphere. The equalization valve 23 restores atmospheric pressure inside the drum 13 at the end of operation. The shutoff valve 21 is open when deenergized and closed when energized.

An electric motor 45 drives the vacuum pump 19 via a clutch (not shown). The motor 45 also turns a belt pulley 47 via a clutch 49. The belt pulley 47 drives a belt 51 that turns the drum 13 to tumble wet clothes (not shown) inside the drum 13. A tension pulley 53 maintains the proper tension in the belt 51 by equipment not shown in the figures.

Four infrared quartz lamps 55, in the 200 to 500 watt power range, are positioned around the drum 13 in a square pattern. Each lamp 55 is partially surrounded by a housing 57 that traps some of the air around each lamp 55. The heat of the lamps 55 radiates through the drum 13, heating the contents. In addition, an induction heater 59 can be employed to provided quick initial heating of the drum contents if there are no metallic objects inside, such as rivets or buttons.

The four housings 57 connect to a header 61 that connects in turn to a hot air line 63. The hot air line 63 connects, via a hot air valve 65, to the vacuum line 19 at a point between the vacuum shutoff valve 21 and the drum 13. The hot air valve 65 is closed when deenergized. The hot air trapped by the housings 57 is used in the drying cycle as described below.

Figure 4:
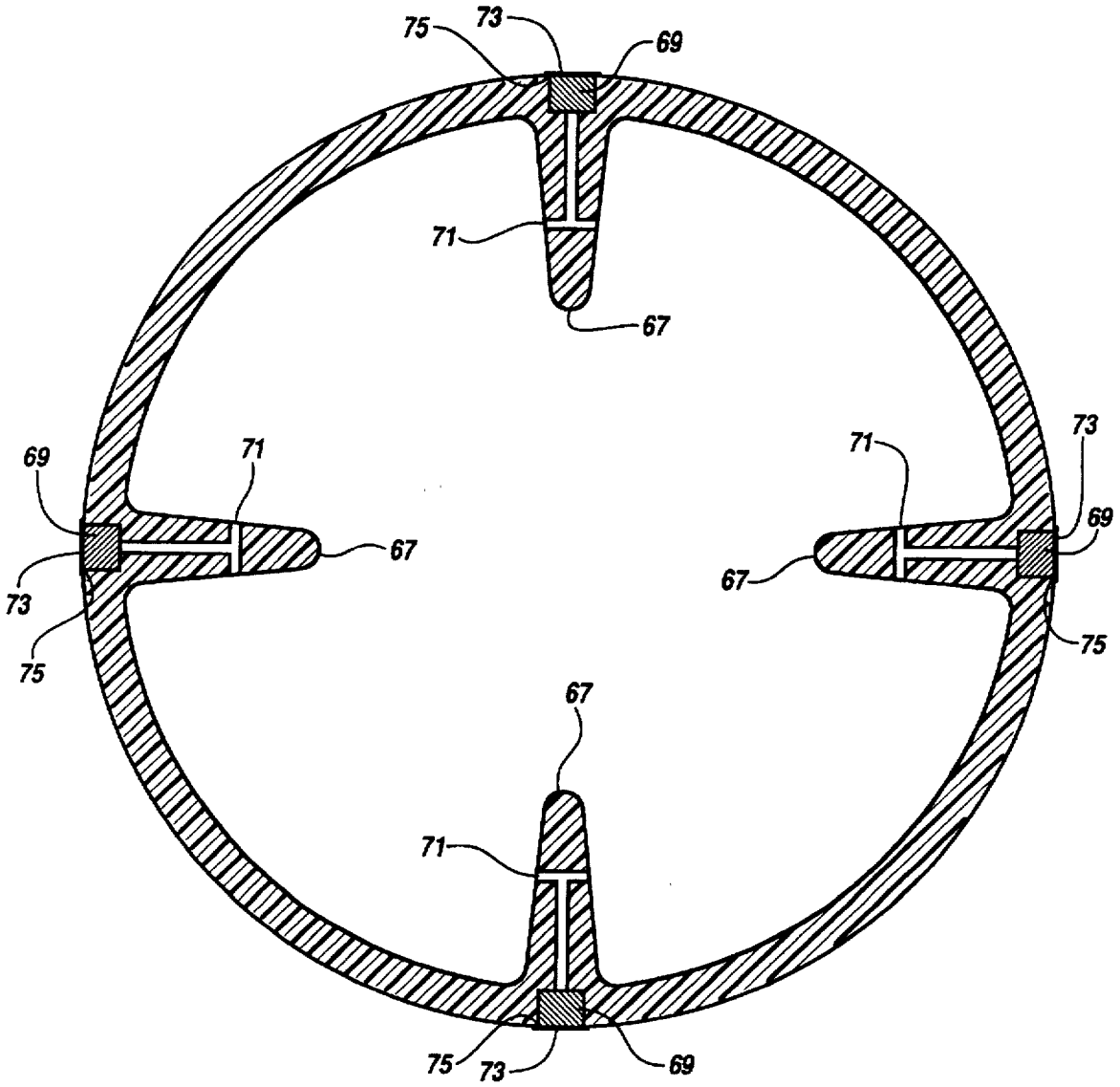
FIG. 4 is cross-sectional view of the drum, taken along lines 4—4 in FIG. 2.

The interior of the drum 13, as shown in FIG. 4, includes four paddles 67, which can be molded in a single piece with the drum 13. Eight moisture purge valves 69 are installed in the drum 13, adjacent to the paddles 67. One side of each purge valve 69 connects to the drum interior via a passage 71 passing through a paddle 67. Each purge valve 69 has a poppet-type plug 73 made of ferromagnetic material. A spring (not shown) biases the valve plug 73 against the valve seat 75 to close the valve 69. A solenoid 76 is installed within each of the lamp housings 55, as seen in FIG. 1. The purge valves 69 are aligned so as to pass under the solenoid 76 as the drum 13 turns. During the drying cycle, the solenoids 76 are continuously energized during certain intervals. Each valve plug 73 will be pulled up, off its seat 71, as it passes by a solenoid 76. Thus, short bursts of air will flow into the drum 13, via the purge valves 69, when the solenoids 76 are energized. The solenoids 76 must be capable of opposing the combined force of a) the pressure differential across the purge valve 69 with a vacuum inside the drum 13, and b) the spring force (not shown). The purge valves 69 should be sized with respect to the capacity of the vacuum pump 15, so that the vacuum pump 15 can maintain the desired pressure in the drum 13.

Operation of the clothes dryer 11 will now be described. Clothes are put in the drum 13 and the door 29 is closed and sealed. A timer (not shown) is turned on, whereupon the vacuum shutoff valve 21, the pressure equalization valve 23, the motor 45, the vacuum pump clutch (not shown), the pulley clutch 49, and the quartz lamps 55 are energized. The induction heater 59 can also be energized at this time, provided there are no metal objects inside the drum 13. The induction heater 59 is run for about three minutes, and then shut off.

The vacuum pump 15 is run with the vacuum shutoff valve 21 open, during which the heat sensor 39 keeps the air leaving the drum 13 at a temperature between 110° and 150° Fahrenheit (43°and 66° Celsius) by turning the quartz lamps 55 on and off as needed. The desired temperature can be selected by the user. When six minutes have passed, the solenoids 76 are energized and the moisture purge valves 69 begin allowing bursts of ambient air into the drum 13. After another ten minutes has passed, the vacuum shutoff valve 21 is closed, the solenoids 76 for the moisture purge valves 65 are deenergized, and the hot air valve 65 is opened. Hot air is drawn away from the lamps 55 and into the drum 13. The hot air valve 65 is kept open from thirty to forty-five seconds and then closed. At the same time, the vacuum shutoff valve 21 is opened.

Opening the shutoff valve 21 causes a rapid, almost instantaneous decompression of the drum, along with an attendant "shock" removal of moisture from the clothes. The equipment between the shutoff valve 21 and the vacuum pump 15 should be sized so that its total internal volume is a significant percentage of the drum's 13 interior volume, preferably greater than five percent, to ensure this rapid decompression.

When the vacuum shutoff valve 21 has been open for six minutes, the solenoids 76 in the lamp housings 57 are again energized, causing the moisture purge valves 69 to open in short bursts. At the same time, the quartz lamps 55 are turned off completely. When five more minutes have elapsed, the motor 45, the vacuum pump clutch 49, and the pulley clutch (not shown) are deenergized, and the pressure equalization valve 23 is opened, restoring atmospheric pressure to the interior of the drum 13. This completes the drying cycle.

An alternative drying cycle is envisioned for drying woolen sweaters and other delicate items. The cycle is substantially identical to the regular cycle, except that the pulley clutch (not shown) is not energized, so that the drum 13 will not turn. Also, the temperature measured by the heat sensor 39 is kept below 115° Fahrenheit (46° Celsius) to prevent excessive heating that can cause shrinking and wrinkling of the items.

Figure 6:
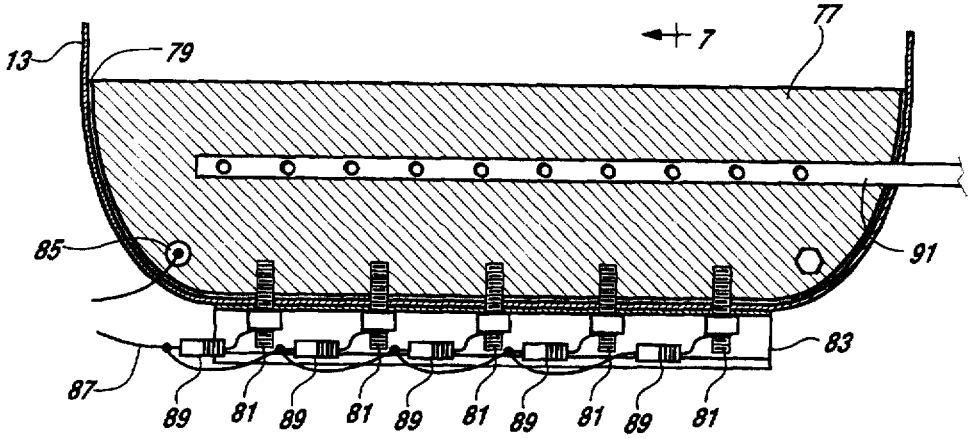
FIG. 6 is a cross-sectional side elevation detail of the cold junction diode/paddle assembly used in an alternative embodiment.
Figure 7:
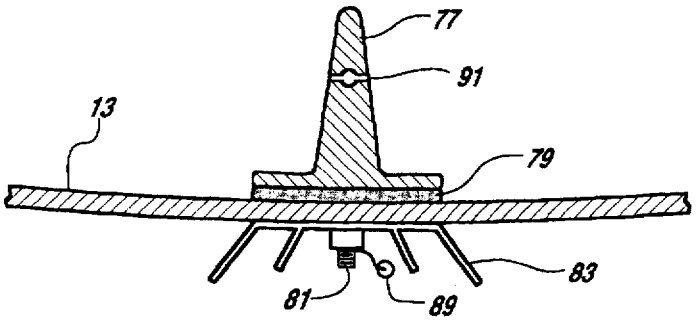
FIG. 7 is an end elevation detail thereof, showing installation on the drum.

An alternate embodiment is envisioned for commercial applications, such as clothes dryers for hotels. In this embodiment, the drum 13 is made of metal and has a diameter of about 4 feet (122 cm). Because the drum 13 is made of metal, the quartz lamps 57 and induction heater 59 employed in the preferred embodiment cannot be used. FIGS. 6 and 7 illustrate the heating means for this embodiment. Metal paddles 77 are mounted to the inside of the drum 13, with an intervening layer of thermal insulation 79. A number of cold junction diodes 81 mount on a heat sink 83, pass through the drum 13, and make secure mechanical and electrical contact with the paddle 77. A temperature sensor 85 installed in the paddle 77 monitors the paddle temperature to prevent damage to the diodes 81 from overheating. Each diode 81 receives power from a common power supply wire 87 via a current limiting resistor 89. The paddle 77 provides the common ground connection for the diodes 81. Passages 91 in the paddle 77 connect to the moisture purge valves (not shown), which can be located, along with their corresponding solenoids 76 in a convenient location. The diodes 81 are powered by direct current, the direction of the current causing the side of the diode 81 connected to the paddle 77 to become hot, and the side mounted on the heat sink 83 to become cold. The heat sink 83 will therefore draw heat out of the surrounding environment, which will partially offset the heating of the environment by the dryer 11 during normal operation.

The clothes dryer of the invention has several advantages over the prior art. The clothes dryers consumes less power because of lower air temperatures required. In fact, a compact model, designed for apartments or smaller loads, could be designed that is capable of working from standard 120 VAC wall power, rather than the 240 VAC, three-phase power normally required for electrically heated clothes dryers. The lower operating temperatures reduce shrinking and wrinkling of clothes. The total drying cycle time is shorter, despite using less power and lower temperatures.

The invention has been shown in two embodiments. It should be apparent to those skilled in the art that the invention is not so limited, but is susceptible to various changes and modifications without departing from the spirit of the invention.

What is claimed is:

1. A clothes dryer for drying wet clothes, wherein the dryer comprises:

a drum, having an inner surface, an open end for admitting the clothes, and a closed end opposite the open end;

a door, adapted to close upon the open end of the drum, and forming an airtight seal thereon;

a bearing, attached to the drum for admitting and connecting a vacuum line to the interior of the drum via an aperture defined in the drum, an airtight seal being formed between the aperture, the bearing, and the vacuum line;

a vacuum pump, connected to the vacuum line;

rotating means for rotating the drum;

heating means for heating the clothes;

a vacuum shutoff valve, located in the vacuum line between the drum and the vacuum pump; and a pressure equalization valve, connected to the vacuum line at a point between the drum and the vacuum shutoff valve, for restoring atmospheric pressure inside the drum.

2. A clothes dryer as recited in claim 1, further comprising a plurality of paddles, attached to the inner surface of the rotating drum, for tumbling the clothes.

3. A clothes dryer as recited in claim 2, further comprising a plurality of moisture purge valves, each purge valve being exposed on one side to the air outside the drum, and on the other side to the interior of the drum via a passage defined in a paddle, for allowing the flow of air from outside the rotating drum into the drum at predetermined intervals.

4. A clothes dryer as recited in claim 3, wherein the drum is transparent to infrared radiation, and the heating means is a plurality of infrared lamps located outside the drum.

5. A clothes dryer as recited in claim 3, wherein the heating means is a plurality of diodes, operative in accordance with the Peltier effect.

6. A clothes dryer for drying wet clothes, wherein the dryer comprises:

a drum, having an inner surface, an open end for admitting the clothes, and a closed end opposite the open end;

a door, adapted to close upon the open end of the drum, and forming an airtight seal thereon;

a bearing, attached to the drum for admitting and connecting a vacuum line to the interior of the drum via an aperture defined in the drum, an airtight seal being formed between the aperture, the bearing, and the vacuum line;

a vacuum pump, connected to the vacuum line;

a motor;

a belt, driven by the motor, for rotating the drum;

infrared lamps for heating the clothes;

a vacuum shutoff valve, located in the vacuum line between the drum and the vacuum pump; and a pressure equalization valve, connected to the vacuum line at a point between the drum and the vacuum shutoff valve.

7. A clothes dryer as recited in claim 6, further comprising a plurality of paddles, attached to the inner surface of the rotating drum, for tumbling the clothes.

8. A clothes dryer as recited in claim 7, further comprising a plurality of moisture purge valves, each purge valve being exposed on one side to the air outside the drum, and on the other side to the interior of the drum via a passage defined in a paddle, for allowing the flow of air from outside the rotating drum into the drum at predetermined intervals.

9. A clothes dryer for drying wet clothes, wherein the dryer comprises:

a drum, having an inner surface, an open end for admitting the clothes, and a closed end opposite the open end;

a door, adapted to close upon the open end of the drum, and forming an airtight seal thereon;

a bearing, attached to the drum;

a vacuum line connected at one end to the interior of the drum via an aperture defined in the drum, an airtight seal being formed between the aperture and the vacuum line;

a vacuum pump, connected to the vacuum line;

a motor;

a belt, driven by the motor, for rotating the drum;

a plurality of paddles, attached to the inner surface of the rotating drum, for tumbling the clothes;

a plurality of diodes, operative in accordance with the Peltier effect, attached to the paddles, the diodes creating heat for heating the clothes;

a vacuum shutoff valve, located in the vacuum line between the drum and the vacuum pump; and a pressure equalization valve, connected to the vacuum line at a point between the drum and the vacuum shutoff valve.

10. A clothes dryer as recited in claim 9, further comprising a plurality of moisture purge valves, each purge valve being exposed on one side to the air outside the drum, and on the other side to the interior of the drum via a passage defined in a paddle, for allowing the flow of air from outside the rotating drum into the drum at predetermined intervals.

* * * * *